US005899323A

United States Patent [19]

Rakus

[11] Patent Number: 5,899,323

[45] Date of Patent: May 4, 1999

[54] ELECTRICAL SWITCHING APPARATUS WITH CONTACT FINGER GUIDE

[75] Inventor: Paul Richard Rakus, Hopewell Township, Pa.

[73] Assignee: Eaton Corporation, Cleveland, Ohio

[21] Appl. No.: 09/074,135

[22] Filed: May 7, 1998

[51] Int. Cl.[6] ..... H01H 33/00

[52] U.S. Cl. ..... 200/244; 218/32; 218/146; 335/8; 335/196

[58] Field of Search ..... 200/244; 218/1, 218/16, 17, 19, 20, 22, 30, 31, 32, 33, 146; 335/8–16, 196, 200, 201, 203

[56] References Cited

U.S. PATENT DOCUMENTS

| | | | |
|---|---|---|---|
| 3,020,374 | 2/1962 | Tootelian | 200/146 |
| 4,346,356 | 8/1982 | Fujiwara et al. | 335/6 |
| 4,574,170 | 3/1986 | Abe et al. | 200/153 G |
| 4,754,245 | 6/1988 | Toda et al. | 335/17 |
| 4,891,617 | 1/1990 | Beatty, Jr. et al. | 335/46 |
| 5,210,385 | 5/1993 | Morel et al. | 200/146 R |
| 5,552,754 | 9/1996 | Sharaf | 335/16 |

*Primary Examiner*—Michael A Friedhofer
*Attorney, Agent, or Firm*—Martin J. Moran

[57] ABSTRACT

A contact guide member extends transversely to the contact fingers on the contact carrier of electrical switching apparatus and has spaced openings through which the contact fingers extend and are held in spaced relation. The contact finger guide member is positioned to isolate the arc toes adjacent the free ends of the contact fingers from the main contacts and the contact springs in order to protect the latter items from the arc gases and debris generated during arcing. The openings in the contact finger guide member are elongated to permit differentially pivoting of the contact fingers, but not axial movement. The contact finger guide member slides in a pocket molded in the end face of the contact carrier and is captured by and moves with the contact fingers.

14 Claims, 12 Drawing Sheets

ELECTRICAL SWITCHING APPARATUS WITH CONTACT FINGER GUIDE

CROSS REFERENCES TO RELATED APPLICATIONS

This application is related to commonly owned, concurrently filed U.S. Pat. applications Ser. Nos. 09/074,046, "ELECTRICAL SWITCHING APPARATUS WITH OPERATING CONDITION INDICATORS MOUNTED IN FACE PLATE"; Ser. No. 09/074,075, "ELECTRICAL SWITCHING APPARATUS WITH IMPROVED CONTACT ARM CARRIER ARRANGEMENT"; Ser. No. 09/074,073, "CHARGING MECHANISM FOR SPRING POWERED ELECTRICAL SWITCHING APPARATUS"; Ser. No. 09/074,240, "ELECTRICAL SWITCHING APPARATUS WITH MODULAR OPERATING MECHANISM FOR MOUNTING AND CONTROLLING LARGE COMPRESSION CLOSE SPRING"; Ser. No. 09/074,233, "ELECTRICAL SWITCHING APPARATUS WITH PUSH BUTTONS FOR A MODULAR OPERATING MECHANISM ACCESSIBLE THROUGH A COVER PLATE"; Ser. No. 09/074,104, "INTERLOCK FOR ELECTRICAL SWITCHING APPARATUS WITH STORED ENERGY CLOSING"; Ser. No. 09/074,133, "CLOSE PROP AND LATCH ASSEMBLY FOR STORED ENERGY OPERATING MECHANISM OF ELECTRICAL SWITCHING APPARATUS"; Ser. No. 09/074,076, "SNAP ACTING CHARGE/DISCHARGE INDICATOR DISPLAYING CHARGE STATE OF CLOSE SPRING ON ELECTRICAL SWITCHING APPARATUS"; Ser. No. 09/074,234, "ELECTRICAL SWITCHING APPARATUS HAVING ARC RUNNER INTEGRAL WITH STATIONARY ARCING CONTACT"; Ser. No. 09/074,052, "DISENGAGEABLE CHARGING MECHANISM FOR SPRING POWERED ELECTRICAL SWITCHING APPARATUS".

The Government has rights in this invention under Government Contract Number N61331-94-C-0078

BACKGROUND OF THE INVENTION

1. Field of the Invention

This invention relates to electrical switching apparatus, and in particular, to such apparatus with multiple contact fingers and to a contact finger guide which maintains spacing between the contact fingers during current interruption and blocks passage of arcing gasses back along the contact fingers.

2. Background Information

Electrical switching apparatus for power distribution systems includes devices such as, for instance, circuit breakers, network protectors, transfer switches and disconnect switches. A common type of power air circuit breaker has a molded casing housing multiple pole assemblies all driven by a common operating mechanism. Each pole includes a contact arm carrier pivoted by the operating mechanism between open and closed positions. The contact arm carriers support contact arms having movable contacts which engage stationary contacts with the contact arm carrier in the closed position. Typically, the contact arm is made up of a number of contact arm laminations or contact fingers mounted on a common pivot pin on the carrier. Contact springs bias the contact fingers against the stationary contacts in the closed position to provide contact pressure and to accommodate for wear.

There is a need to locate the contact fingers laterally against magnetic loads during short circuit conditions. The contact fingers tend to sway from side to side due to the magnetic effects of adjacent poles which are out of phase. This allows the moving contacts to slide on the stationary contacts. During interruption, when the contact fingers are arcing, magnetic forces tend to pull the ends of the fingers together, toward the center of the pole. The fingers may bend, touch at their tips, and even weld together, losing their independent action. Separating fins may be molded into the carrier, but they are difficult to mold and often break during interruption. The taper required to mold them limits their effectiveness in locating the contact fingers. Also, there is a need to protect the contact springs from arc generated debris, which can collect between coils, limiting spring travel after interruption. The contact carrier partially shrouds the springs, but there must be enough clearance to allow the fingers to pivot to the fully compressed position.

There is a need therefore for an improved electrical switching apparatus with plural, parallel spaced contact fingers arranged to prevent bending and welding together of the contact fingers during arcing.

There is a further need for such an improved electrical switching apparatus which protects the contact springs and main contacts from arc gases and debris generated at separate arcing contacts.

There is an associated need for such electrical switching apparatus which achieves these results with simple, economical arrangements of the parts.

SUMMARY OF THE INVENTION

These needs and others are satisfied by the invention which is directed to electrical switching apparatus which includes a contact guide member extending transversely to the plurality of elongated contact fingers pivotally mounted on a contact carrier which is mounted for movement between a closed position of movable contacts mounted on the contact fingers with stationary contacts, and an open position in which the contacts are separated. The contact guide member has spaced openings through which contact fingers extend and are held separated. Mounting means mount the contact guide member on the contact carrier for sliding movement as the contact fingers rotate about a pivot pin on the carrier. Preferably, the mounting means for the contact guide member is a pocket in the contact carrier in which the guide member is slidably received. The guide member is captured for sliding movement in the pocket by the contact fingers. In the preferred embodiment of the invention, the pocket in which the guide members slides is an end face of the contact carrier. The contact fingers are pivotally mounted on a pivot pin on the carrier and are biased about the pivot pin by contact springs. The guide member slides in and out of the pocket as the contact fingers rotate on the contact carrier. The guide member extends transversely to the contact fingers between arcing toes on the free ends of the contact fingers and the contact springs. The guide members also position between the main contacts and the arcing toes. Thus, the contact springs and the main contacts are protected from the arcing gases and debris generated by the arcing contacts. The guide members have slots through which the guide fingers extend. These slots are sized to allow differential location of movement of the contact fingers. The guide member restricts lateral movement of the contact fingers and resists bending of the contact fingers by the sizable magnetic forces generated during a high current short circuit.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention is applicable to electrical switching apparatus such as, for example, circuit breakers, network protectors, transfer switches and disconnect switches, and will be described as applied to a power circuit breaker.

Figure 1:
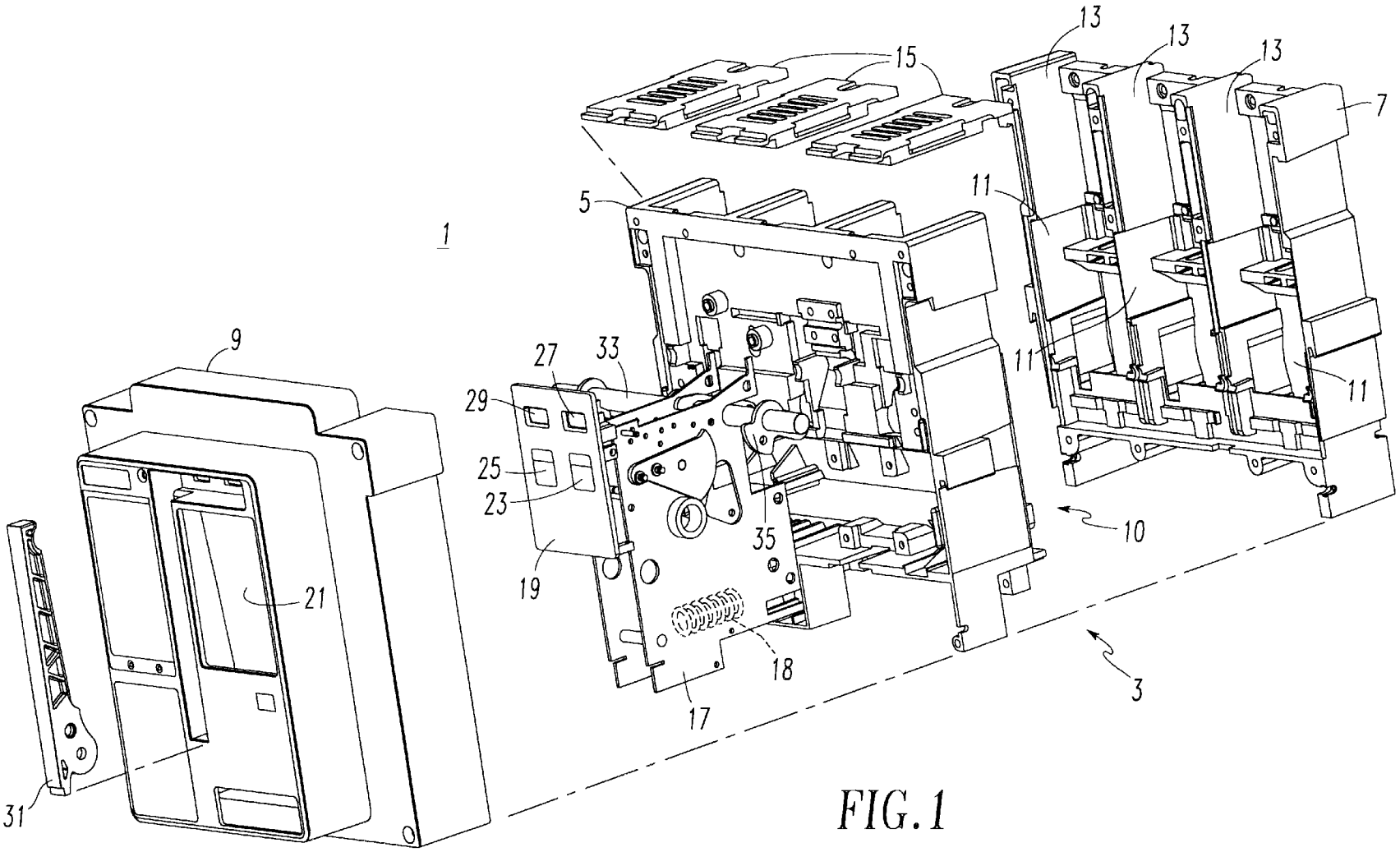
FIG. 1 is an exploded isometric view of a power air circuit breaker incorporating the invention.

Referring to FIG. 1, the power air circuit breaker 1 of the invention has a housing 3 which includes a molded front casing 5 and rear casing 7, and a cover 9. The exemplary circuit breaker 1 has three poles 10 with the front and rear casings 5, 7 forming three pole chambers 11. Each pole 10 also has an arc chamber 13 which is enclosed by a ventilated arc chamber cover 15.

The circuit breaker 1 has an operating mechanism 17 which is mounted on the front of the front housing 5 and is enclosed by the cover 9. The operating mechanism 17 has a front face 19 which is accessible through an opening 21 in the cover. The operating mechanism 17 includes a large spring 18 which is charged to store energy for closing the circuit breaker. The face plate 19 mounts a push to close button 23 which is actuated to discharge the close spring for closing the circuit breaker and a push to open button 25 for opening the circuit breaker. Indicators 27 and 29 display the condition of the charge spring and the open/close state of the contacts, respectively. The charge spring is charged by operation of the charging handle 31 or remotely by a motor operator (not shown).

The common operating mechanism 17 is connected to the individual poles by a pole shaft 33 having a lobe 35 for each pole. As is conventional, the operating mechanism 17 includes a trip unit (not shown) which actuates the operating mechanism to open all the poles of the circuit breaker through rotation of the pole shaft 33 in response to predetermined characteristics of the current flowing through the circuit breaker.

As illustrated in FIGS. 2*a*–2*d*, each pole of the circuit breaker 1 includes separable main contacts 37 comprising stationary main contacts 39 and movable main contacts 41. The stationary main contacts 39 are secured to a line conductor 43 which is mounted in and projects rearwardly from the rear casing 7. The movable main contacts 41 are mounted on a moving conductor assembly 45. This assembly includes a contact carrier 47 on which a plurality of contact fingers 49 are pivotally mounted by a pivot pin 51. The movable main contacts 41 are fixed to the contact fingers 49 about midway between the pivot pin 51 and a first or free end 53. Adjacent to the free end 53 of the contact fingers is an arc toe 55 forming a movable arcing contact which cooperates with a toe block 57 forming a stationary arcing contact secured to the line conductor through an electrically conductive spacer 59 to form a set of arcing contacts.

The moving conductor assembly 45 further includes flexible shunts 61 connecting the contact fingers 49 to a load conductor 63 also projecting rearwardly from the rear casing 7. As is conventional, an arc chute 65 is provided in the arc chamber 13. An arc runner 67 guides the arc from the toe block to the arc chamber where it is extinguished in a known manner.

Figure 2A:
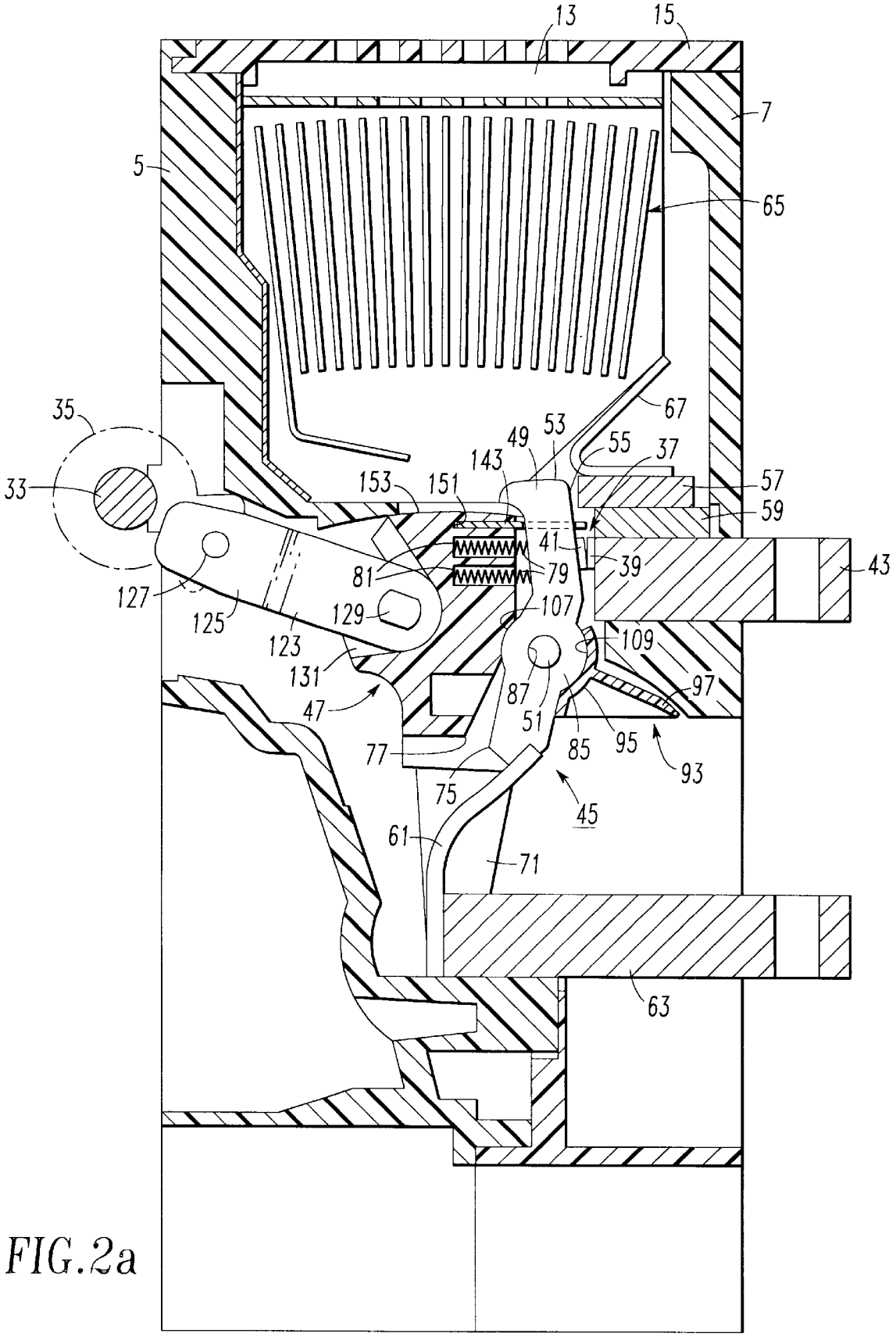
FIG. 2*a* is a vertical section through the circuit breaker of FIG. 1 shown in the fully closed position.
Figure 2B:
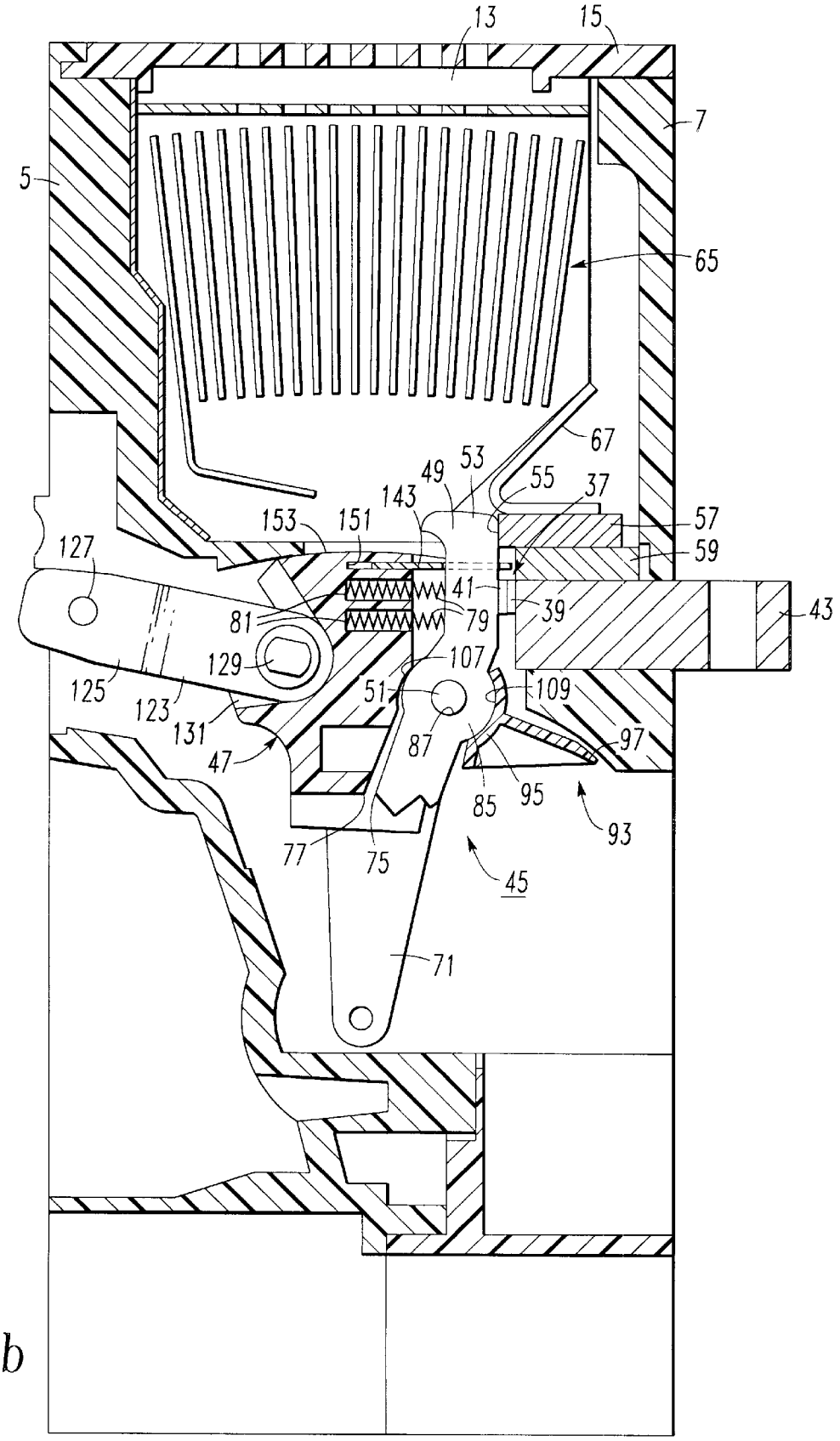
FIG. 2*b* is similar to FIG. 2*a* but illustrating simultaneous contact and toe touch during the closing sequence of the circuit breaker.
Figure 2C:
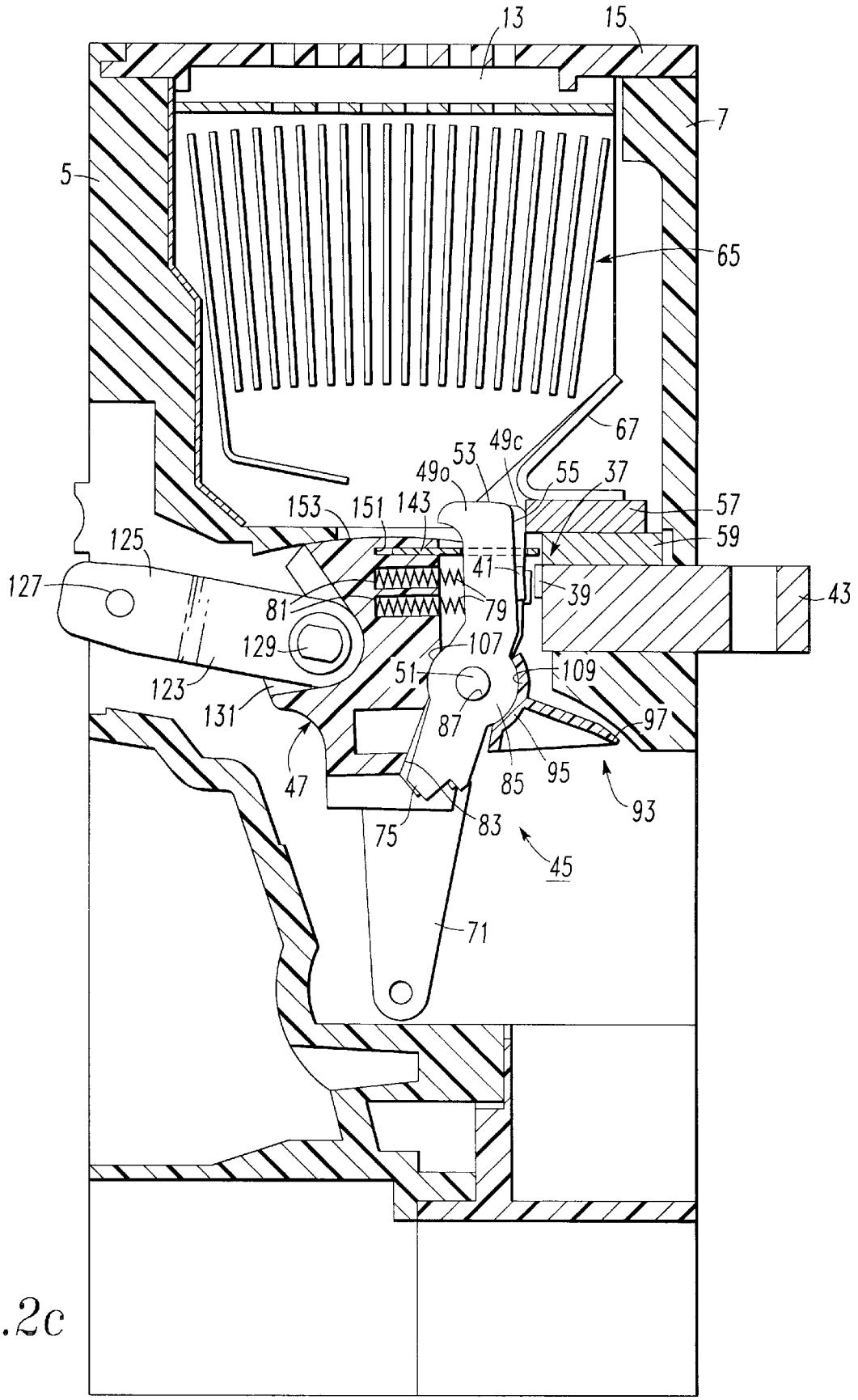
FIG. 2*c* is similar to FIG. 2*a* but showing the contact fingers about to break contact at the arcing toe.
Figure 2D:
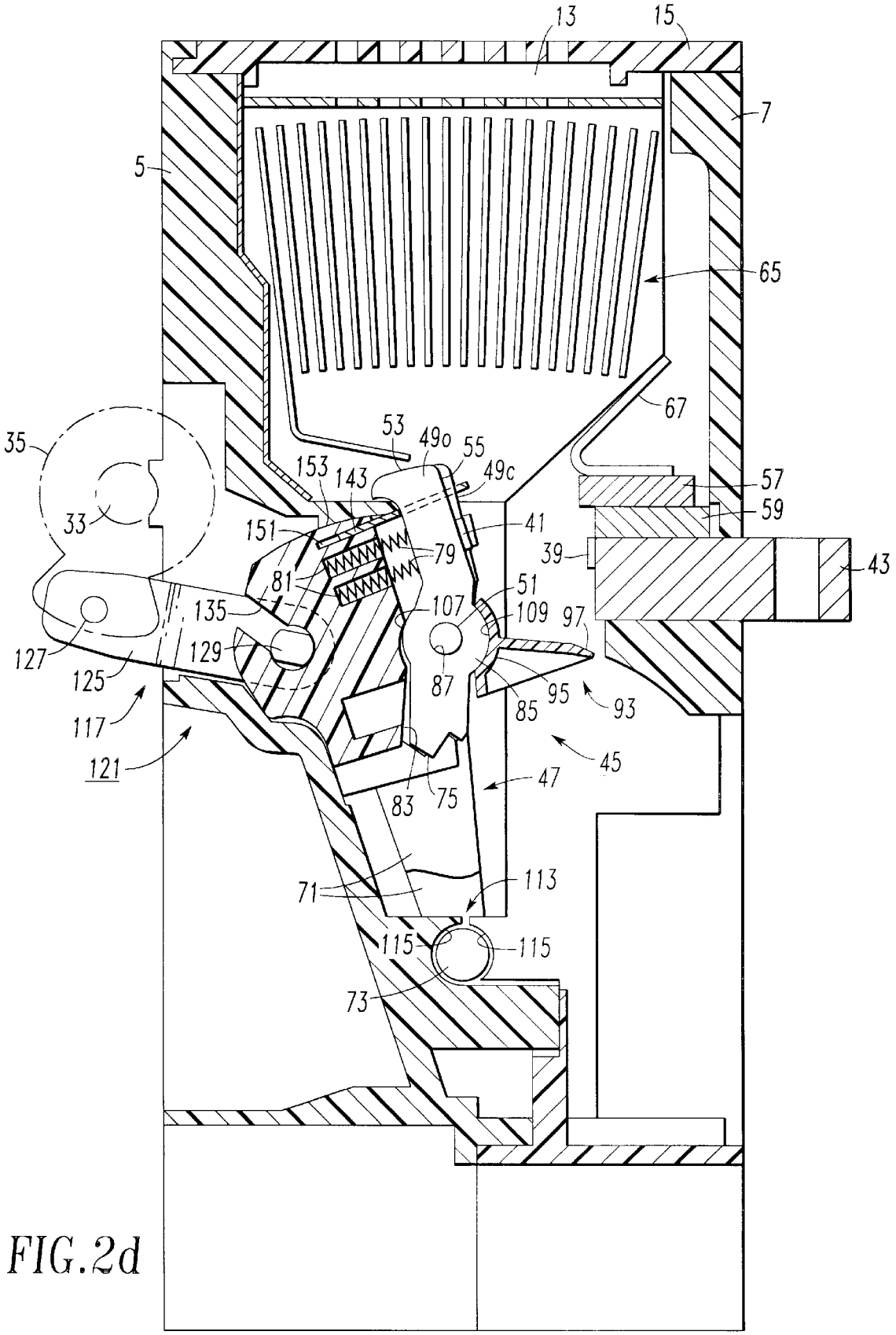
FIG. 2*d* is similar to FIG. 2*a* but showing the contact carrier in the fully open position.
Figure 3:
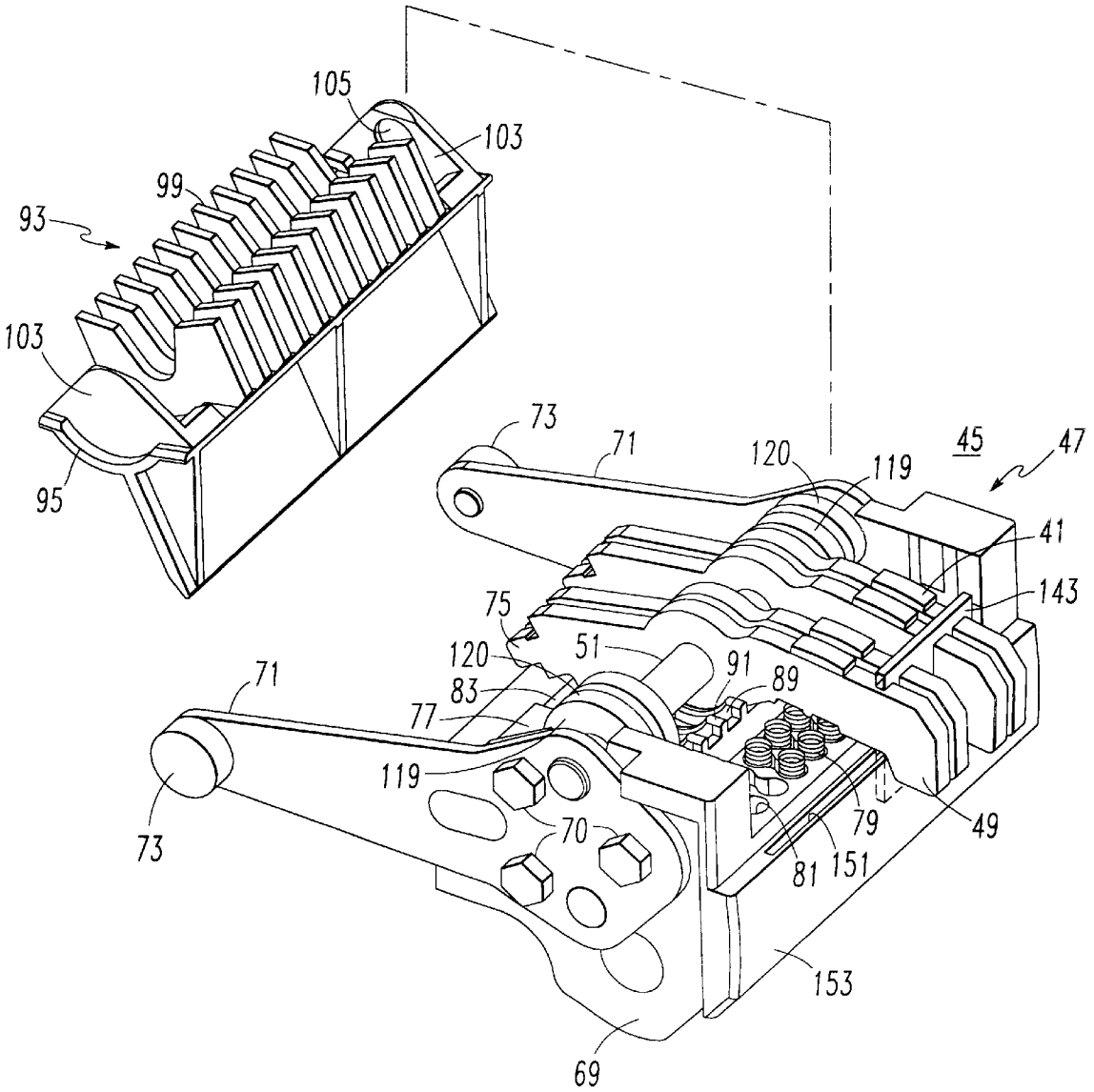
FIG. 3 is an isometric view of the contact carrier which forms part of the circuit breaker with some parts eliminated for clarity and with the seal member removed and rotated.
Figure 4:
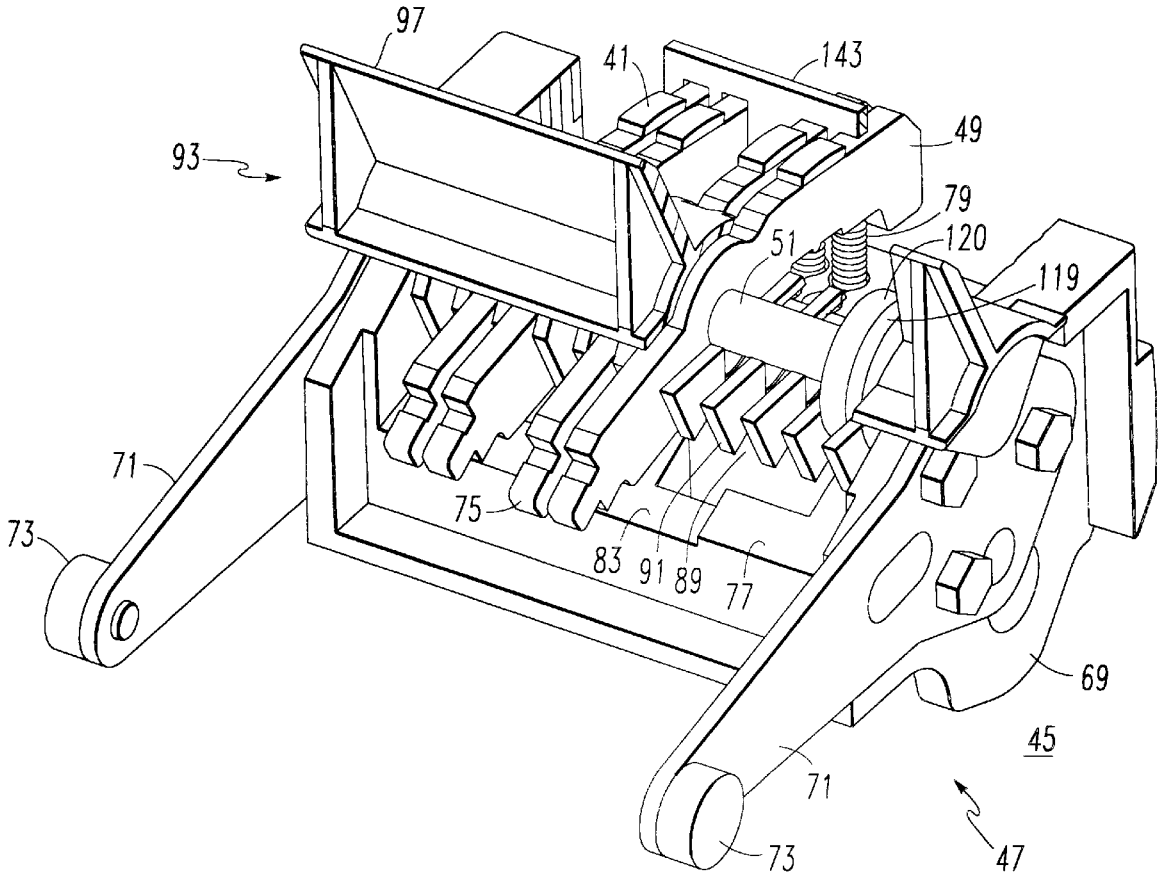
FIG. 4 is an isometric view of the contact carrier from another angle showing some parts eliminated as in FIG. 3, and with the seal member in place but partially cut away.
Figure 5:
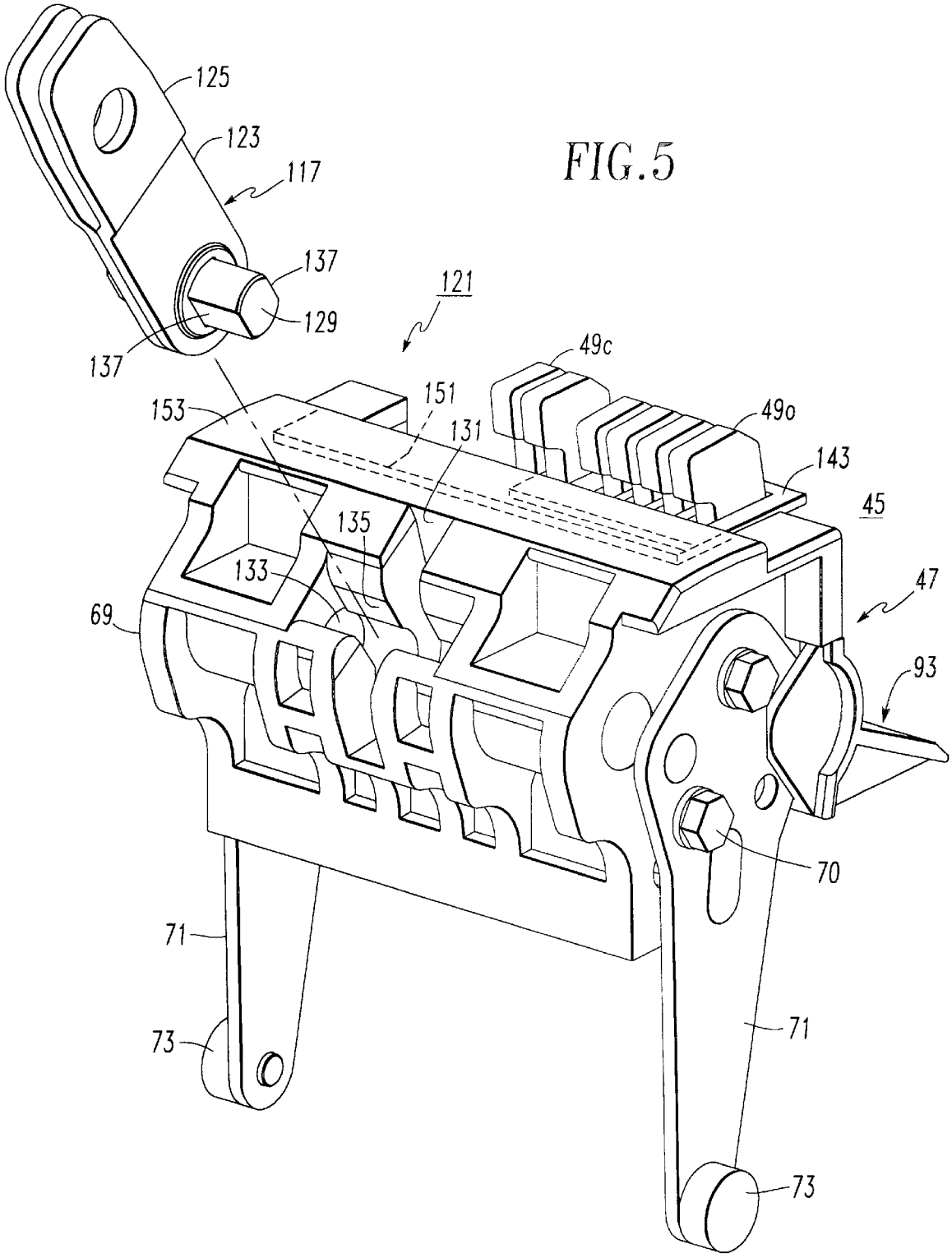
FIG. 5 is an isometric view of the underside of the contact carrier with the drive link assembly separated from the carrier.

Turning to FIGS. 3, 4 and 5 in addition to FIGS. 2*a*–2*d*, the contact carrier 47 includes a molded body 69 and a pair of legs 71 secured to the ends of the body 69 by bolts 70. Mounting pivots 73 project outwardly from the free ends of the legs 71. The pivot pin 51 is supported at its ends in the legs 71. The contact fingers 49 are pivotally mounted on the pivot pin 51. Second ends 75 of the contact fingers 49 are biased against a stop ledge 77 on the molded body 69 by a pair of contact springs 79 seated in recesses 81 in the molded body. The stop ledge 77 has a contour which includes a recessed section 83 in the center of the stop ledge. This allows the contact springs 79 to rotate the center contact fingers which are aligned with the recess 83 to project the first or free ends 53 further from the contact carrier than the other, outside, contact fingers.

The contact fingers 49 have enlarged sections 85 extending radially outward from the mounting aperture 87 which extend into grooves 89 in the carrier body. The grooves 89 are defined by fins 91 which extend between and axially space the contact fingers on the pivot pin 51. The contact carrier 47 also includes a seal member 93 which is best seen in FIG. 3 where it has been removed from the carrier 47 and rotated 180°. This seal member 93 has an arcuate base 95 from which a shield panel 97 extends outward. Fins 99 extend radially inward from the seal base to form grooves 101. End walls 103 on the base 95 have confronting circular recesses 105 which engage the ends of the pivot pin 51 to secure the seal member to the carrier body 69 as seen in FIG. 4. In this assembled position, the fins 99 on the seal member 93 extend between the contact fingers 49 and align with the fins 91 on the carrier body to form a seal which prevents the flow of arc gases from passing through the spaces between the contact fingers. As can be seen from FIG. 2*d* the seal panel 97 additionally restricts flow of arc gases around the carrier 47 as the contacts open.

Referring to FIG. 2*a*, the enlarged sections 85 of the contact fingers 49 have radial convex surfaces 107 which seat on radially concave surfaces 109 and 111 in the grooves 89 in the carrier body and grooves 101 in the seal member. These surfaces serve to transmit reaction forces between the contact fingers 49 and the carrier body 69 to prevent bending of the pivot pin 51. This permits the pin 51 to be made of lighter gage or more economical material. Also, the supports for the pivot pin 51, namely the legs 71, have reduced loads to support. This seating of the radial surfaces maintains the gas seal while allowing the contact fingers to rotate.

As shown in FIG. 2*d*, the contact carrier 47 is pivotally mounted for rotation to open and close the separable contacts 37. Bearing pockets 113 are formed by mating recesses 115 in the front casing 5 and rear casing 7 for the pivot 73 on the free ends of the legs 71. The carrier 47 is rotated about the pivots 73 by a link assembly 117 pivotally connected to the pole lobe 35 on the pole shaft 33.

The operation of the circuit breaker 1 is as follows: with the contact carrier 47 rotated to the fully closed position shown in FIG. 2*a*, the separable contacts 37 are closed to complete a circuit which includes the line conductor 43, the fixed contacts 39, the movable contacts 41, the contact arms 49, the flexible shunts 61 and the load conductor 63. In this fully closed position, the arcing contacts are open. Also, in the fully closed position the second ends 75 of the contact arms are spaced from the stop ledge 77. The contact springs 79 maintain contact pressure between the fixed and movable contacts 39, 41.

As the circuit breaker begins to open, the contact carrier 49 begins to rotate counterclockwise to the position shown in FIG. 2*b*. In this position, with the carrier slightly spaced counterclockwise from the position in FIG. 2*a*, the contact springs 79 rock the contact fingers 49 clockwise so that they rock about the separable contacts 37 and close the arcing contacts. At this point, current flows both through the closed separable contacts and arcing contacts. As the contact carrier continues its counterclockwise rotation during opening and reaches the position shown in FIG. 2*c* the separable contacts have separated. In addition, the second ends 75 of the outer contact fingers 49*o* in FIG. 2*c* have seated on the stop ledge 77 and are therefore rotated with the carrier to open the associated arcing contacts as well as the separable contacts. However, the second ends of the center contact fingers 49*c* enter the recess 83 in the stop ledge 77 and therefore can continue to rotate and maintain the center arcing contacts closed. Continued rotation of the carrier 47 in the counterclockwise direction then results in the drawing of an arc between a toe block 57 and the arc toes 55*c* on the center contact fingers only. This arc is then transferred by the arc runner 67 to the arc chute 65 where it is extinguished.

FIG. 2*d* shows the carrier in the fully open position with the center contact fingers 49*c* advanced. Thus, as the carrier 47 moves to the closed position during the next closing cycle, the arcing contacts of the center contact arms will touch first followed by the arcing contacts of the outer contact fingers. This will cause the contact fingers to rock to the position shown in FIG. 2*b* where both the arcing contacts and the separable contacts are closed. As the carrier reaches the fully closed position of FIG. 2*a*, the arcing contacts separate and all the current flows through the closed separable contacts 37.

The circuit breaker 1 is constructed in modular form so that the same basic construction can be used for a wide range of current ratings. For the highest current rating, the maximum number of contact fingers are installed in the carrier. For the exemplary carrier, this is 12 contact fingers. For such high current ratings an additional set of flexible shunts (not shown) can be connected between the contact fingers and the load conductor 63. In these applications, larger line conductors 43 and load conductors 63 are used. For lower current ratings, fewer contact fingers 49 are required. In these circumstances, annular spacers 119 replace the removed contact fingers. Thus, as shown in FIGS. 3 and 4, the two outer contact fingers at each end of the carrier have been replaced by these annular spacers 119. These annular spacers perform two functions: they have the same radially convex surface 120 which seats against the radial surfaces 109 and 111 as the contact fingers they replace to transmit reaction forces between the contact fingers and the carrier, and they block the flow of arc gases.

Figure 6:
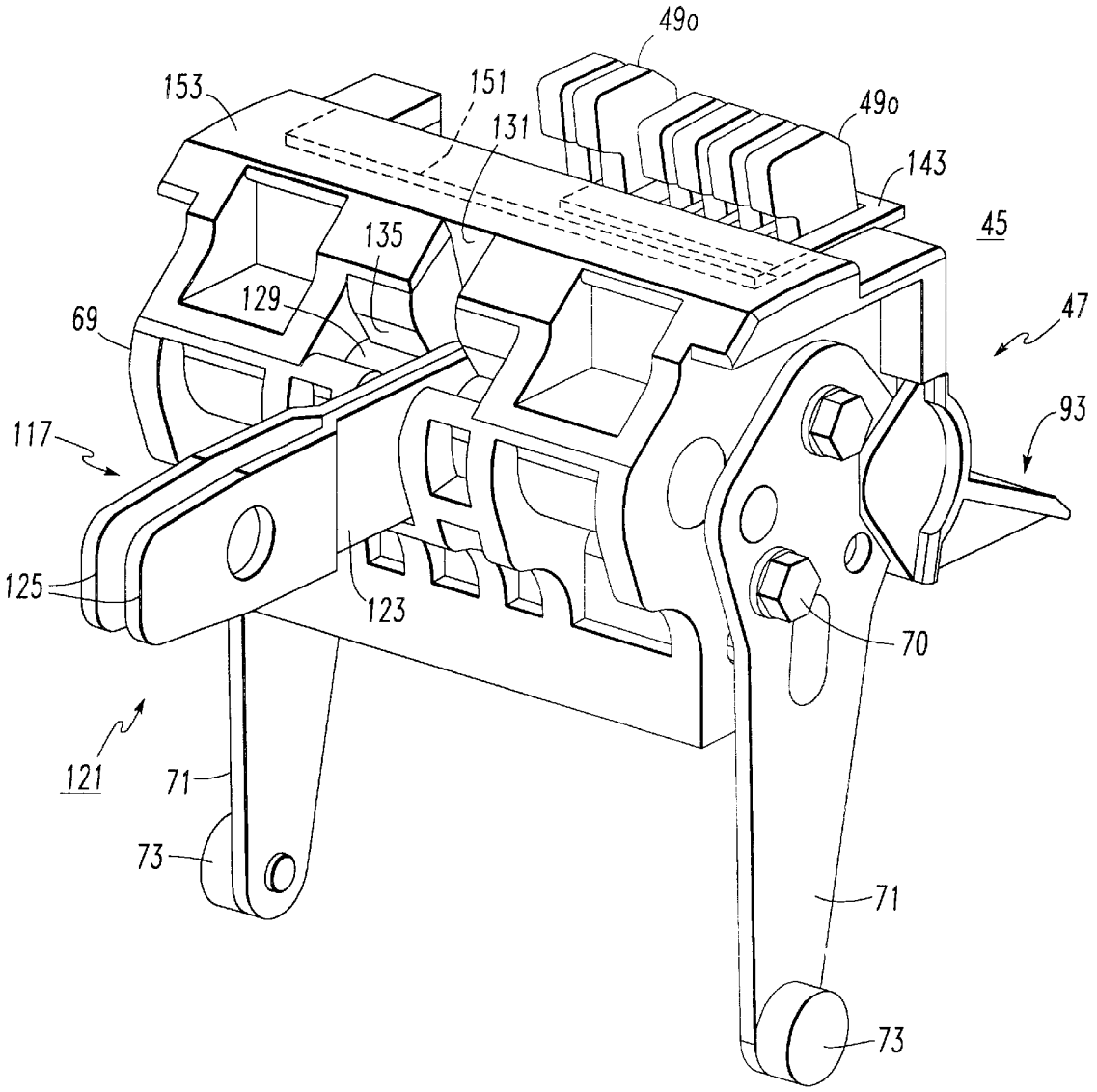
FIG. 6 is a view similar to FIG. 5 showing the drive link assembly engaging the carrier.
Figure 7:
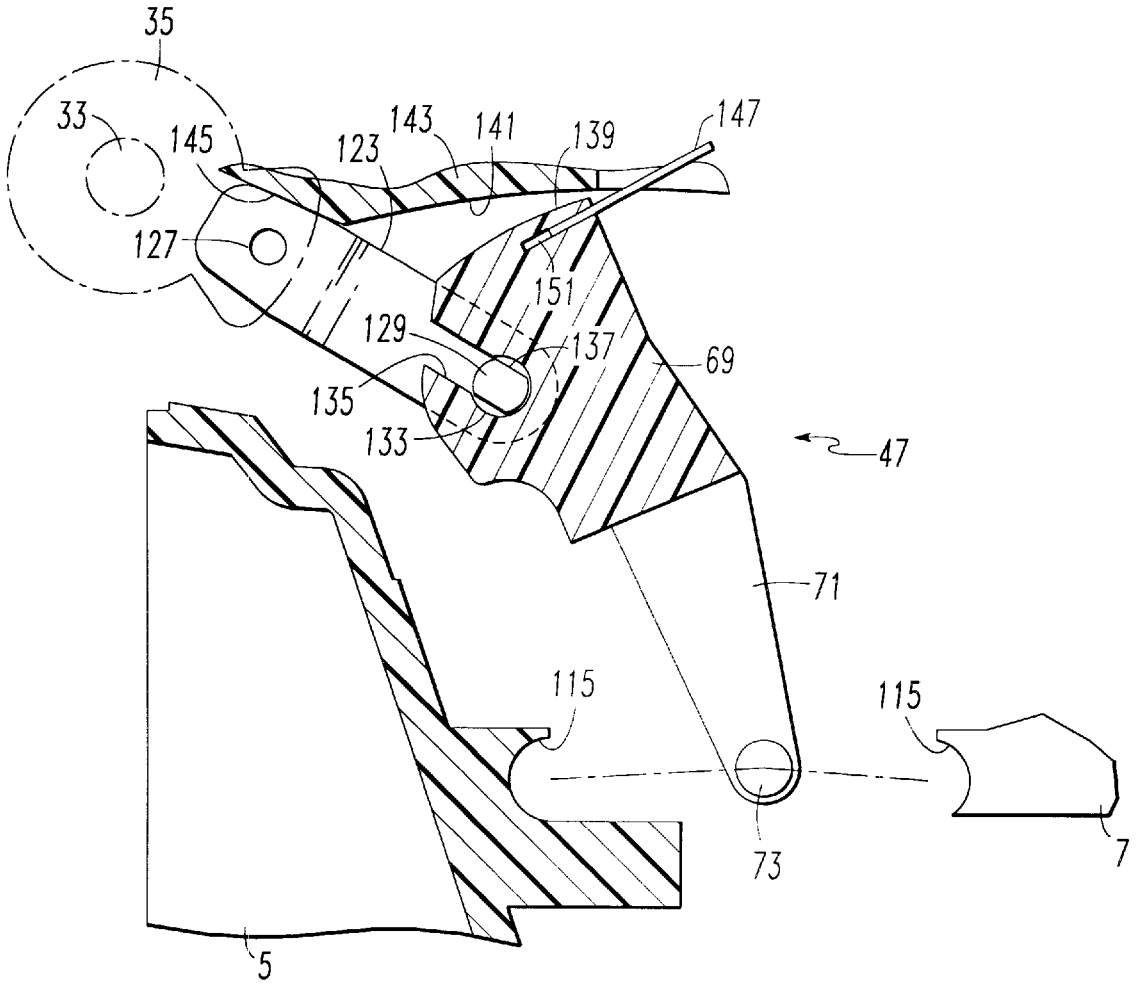
FIG. 7 is a schematic view showing the contact carrier rotated to disconnect the carrier from the drive link for removal from the circuit breaker.

Another unique aspect of the circuit breaker 1 is the connection 121 between the carrier 47 and the pole shaft lobe 35. Referring to FIGS. 2*a*, 5 and 6, this connection 121 comprises the link assembly 117 and its pivotal connection to the pole lobe 35 and to the carrier 47. The link assembly 117 includes a pair of links 123 having off-set ends 125 which straddle the pole lobe 35 to which they are connected by a pin 127. A drive pin 129 extends transversely through the other ends of the links 123 and is fixed thereto so that it cannot rotate with respect to the links. The back of the carrier 47 is provided with a groove 131 sized to pivotally receive the links 123. A circular passage 133 is molded into the contact carrier 47 transverse to the groove 131. A pair of slots 135 in the groove 131 lead to the passage 133. The drive pin 129 is freely rotatable in the passage 133, but is keyed by flats 137 to slide through the slots 133 only at a predetermined rotational orientation between the drive pin 129 and the contact carrier 47. This predetermined position between the drive pin 129 and the carrier 47 cannot be established with the carrier pivotally mounted in the housing 3 for the normal range of rotation between the closed and open positions as shown in FIGS. 2*a*–2*d*. As previously discussed, the pivots 73 on the legs 71 of the contact carrier are captured in bearing pockets 113 formed by the confronting recesses 115 in the front casing 5 and rear casing 7. In order to install or remove the carrier 47, the rear casing 7 is removed. This allows the pivot 73 to be moved to the right by rotation of the arcuate surface 139 on carrier body 69 centered on the pivots 73 against the surface 141 on the front casing 5 as shown in FIG. 7. This aligns the slots 135 with the flats 137 on the drive pin 129 so that as the contact carrier 47 is withdrawn to the right the drive pin 129 passes through the slots 135. Preferably, the links 123 are provided with a camming surface 145 which bears against the partition 143 in the housing to position the links 123 as shown in FIG. 7 for installation of a new or repaired contact carrier 47.

Figure 8:
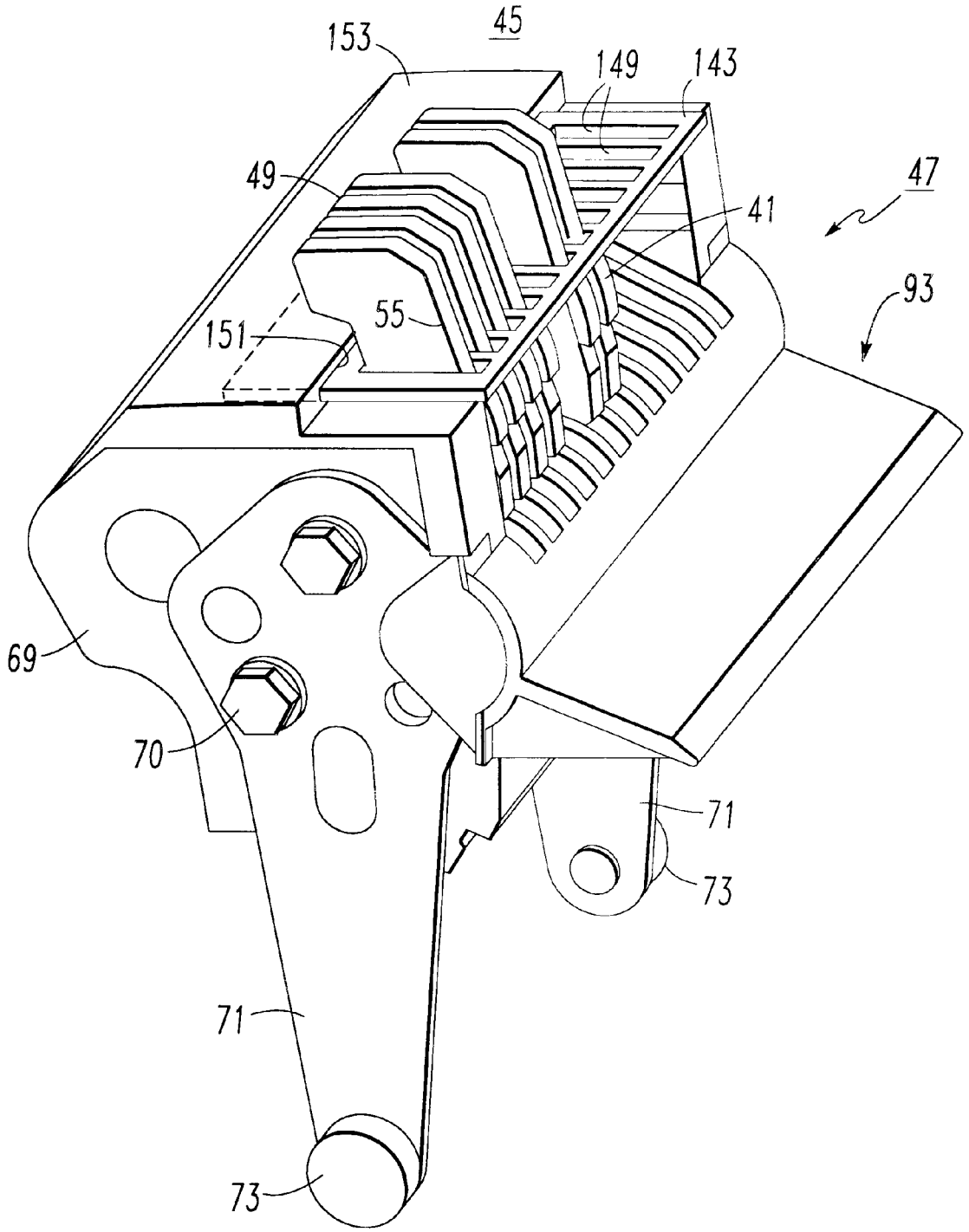
FIG. 8 is an isometric view of the contact carrier with a contact guide member shown with parts broken away and with the guide fingers in the retracted position.
Figure 9:
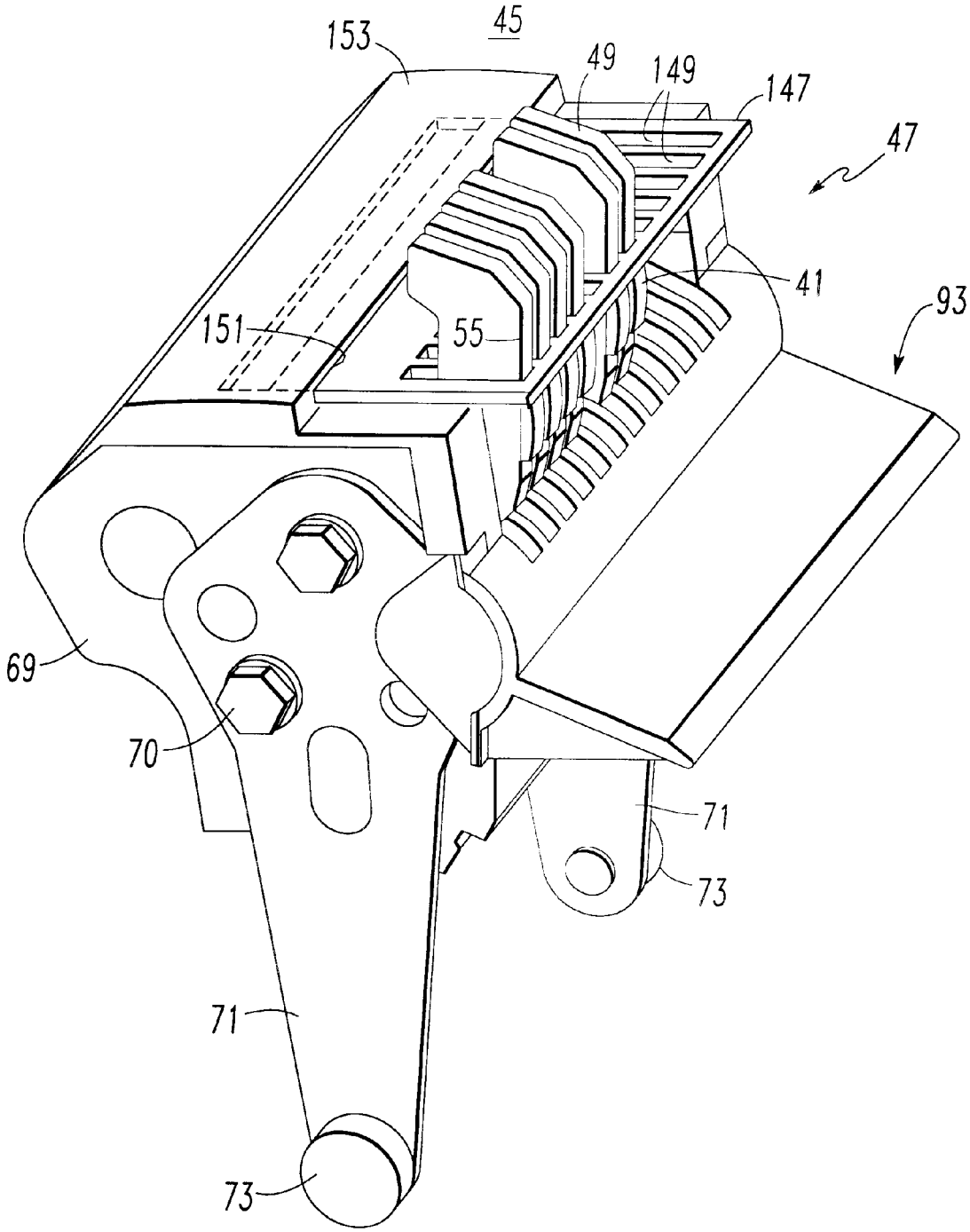
FIG. 9 is a view similar to that of FIG. 8 but showing the guide fingers extended.

FIGS. 8 and 9 illustrate a contact finger guide member 147 which is provided on the contact carrier 47 to protect the main separable contact 37 from arcing gases and debris generated at the arcing contacts 57 and 59 during current interruption. The contact finger guide member 147 is a panel of electrically insulative material having a slot 149 for each of the contact fingers 49. The panel 147 is mounted on the carrier by a pocket 151 molded into the end face 153 of the carrier body 69. The panel 147 is captured for sliding movement in the pocket 151 by the contact fingers 49. As can be seen, the panel 147 extends transversely to the contact fingers between the arcing toes 55 and the main contacts 41. It also separates the contact springs 79 from the arcing toes 55. Thus, the springs and the main contacts are protected from the arc gases and debris generated during current interruption.

The slots 149 are sized to accommodate the differential rotation of the contact fingers 49. As discussed above, the center contact fingers project father toward the stationary contacts when the carrier is in the open position than the outer contact fingers. The slots 149 are sufficiently long that they do not interfere with this operation of the contact fingers. As can be seen in FIG. 8, the finger guide member 147 is pushed into the pockets 151 by the rotation of the contact fingers 49 relative to the carrier body 69 during closing of the contacts. As the breaker opens, the finger guide member 147 is pulled out of the pocket 151 as the fingers 49 rotate on the carrier 47 as shown in FIG. 9.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. Electrical switching apparatus comprising:

a housing; and at least one pole comprising:

a stationary conductor having stationary contacts;

a plurality of contact fingers, each having a movable contact;

a contact carrier having a pivot pin on which said plurality of contact fingers are rotatably mounted in spaced parallel relation;

first mounting means rotatably mounting said contact carrier for movement between a closed position in which said movable contacts engage said stationary contacts, and an open position in which said movable contacts are spaced from said stationary contacts;

contact springs mounted in said contact carrier and biasing said plurality of contact fingers about said pivot pin to apply contact pressure to said movable contacts with said contact carrier in said closed position; and a contact finger guide member extending transversely to said contact fingers and having spaced openings through which said contact fingers extend and are held separated, and second mounting means mounting said contact finger guide member on said contact carrier for sliding on said contact carrier as said contact fingers rotate about said pivot pin.

2. The electrical switching apparatus of claim 1, wherein said second mounting means comprises a pocket in said contact carrier in which said contact finger guide member is slidably received.

3. The electrical switching apparatus of claim 2, wherein said contact carrier has an end face and said pocket is in said end face.

4. The electrical switching apparatus of claim 1, wherein said contact fingers have arcing toes adjacent a free end and wherein said second mounting means mounts said contact finger guide member for sliding transversely to said contact fingers between said arcing toes and said contact springs.

5. The electrical switching apparatus of claim 4, wherein said second mounting means comprises a pocket in said contact carrier in which said contact finger guide member is slidably received.

6. The electrical switching apparatus of claim 1, wherein said contact fingers have a pivot aperture through which said pivot pin extends and movable arcing toes spaced from said pivot aperture and wherein said movable contacts comprise movable main contacts positioned between said pivot aperture and said movable arcing toes on said contact fingers and said second mounting means mounts said contact finger guide member to extend transversely of said contact fingers between said movable arcing toes and said movable main contacts.

7. The electrical switching apparatus of claim 6, wherein said second mounting means mounts said contact finger guide member to extend transversely of said contact fingers between said arcing toes and said contact springs.

8. The electrical switching apparatus of claim 1, wherein said openings in said contact finger guide member are sized to accommodate a predetermined differential rotation of said contact fingers about, but not axial movement along, said pivot pin.

9. The electrical switching apparatus of claim 8, wherein said openings in said contact finger guide member are sized such that said contact fingers engage and slide said contact finger guide member with rotation of said contact fingers while accommodating said predetermined differential rotation of said contact fingers.

10. The electrical switching apparatus of claim 9, wherein said contact fingers have a pivot aperture through which said pivot pin extends, and arcing toes on said elongated contact fingers spaced from said pivot aperture, and wherein said movable contacts comprise movable main contacts on said contact fingers between said pivot aperture and said movable arcing toes, said contact finger guide member extending transversely of said elongated contact fingers between said arcing toes and said movable main contacts.

11. The electrical switching apparatus of claim 10, wherein said second mounting means comprises a pocket in said contact carrier in which said contact fingers guide member is slidably received.

12. The electrical switching apparatus of claim 9, wherein said contact fingers have arcing toes adjacent a free end and wherein said second mounting means mounts said contact finger guide member for sliding transversely to said contact fingers between said arcing toes and said contact springs.

13. The electrical switching apparatus of claim 12, wherein said second mounting means comprises a pocket in said contact carrier in which said contact finger guide member is slidably received.

14. The electrical switching apparatus of claim 13, wherein said movable contacts comprise movable main contacts on said contact fingers spaced from said arcing toes and said pocket in which said contact finger guide member is slidably received is located between said arcing toes and said movable main contacts as well as said contact springs.

* * * * *